US009909728B2

(12) United States Patent
Dong

(10) Patent No.: US 9,909,728 B2
(45) Date of Patent: Mar. 6, 2018

(54) ILLUMINATION DEVICES

(71) Applicant: Shenzhen Yameite Technology Co. Ltd., Shenzhen (CN)

(72) Inventor: Haisong Dong, Shenzhen (CN)

(73) Assignee: SHENZHEN YAMEITE TECHNOLOGY CO. LTD., Shenzhen (CN)

( * ) Notice: Subject to any disclaimer, the term of this patent is extended or adjusted under 35 U.S.C. 154(b) by 0 days.

(21) Appl. No.: 15/014,789

(22) Filed: Feb. 3, 2016

(65) Prior Publication Data

US 2016/0153630 A1 Jun. 2, 2016

Related U.S. Application Data

(63) Continuation-in-part of application No. 14/328,954, filed on Jul. 11, 2014, now Pat. No. 9,574,748.
(Continued)

(30) Foreign Application Priority Data

| | | |
|---|---|---|
| Jul. 30, 2013 | (CN) | 2013 2 0480832 U |
| Aug. 28, 2013 | (CN) | 2013 2 0547507 U |
| Nov. 12, 2013 | (CN) | 2013 2 0711701 U |
| Apr. 4, 2014 | (CN) | 2014 2 0165185 U |
| Mar. 23, 2015 | (CN) | 2015 1 0128281 |

(51) Int. Cl.

| | |
|---|---|
| ***F21S 10/04*** | (2006.01) |
| ***F21S 6/00*** | (2006.01) |
| *F21S 9/02* | (2006.01) |
| *F21V 14/02* | (2006.01) |
| *F21V 23/00* | (2015.01) |

(Continued)

(52) U.S. Cl.
CPC ..... *F21S 10/046* (2013.01); *F21S 6/001* (2013.01); *F21S 9/02* (2013.01); *F21V 14/02* (2013.01); *F21V 23/002* (2013.01); *F21W 2121/00* (2013.01); *F21Y 2115/10* (2016.08)

(58) Field of Classification Search
CPC ..... F21V 14/02; F21S 6/001; F21S 10/046
See application file for complete search history.

(56) References Cited

U.S. PATENT DOCUMENTS

| | | | |
|---|---|---|---|
| 2,976,450 | A | 3/1961 | Benoliel et al. |
| 4,965,707 | A | 10/1990 | Butterfield |

(Continued)

FOREIGN PATENT DOCUMENTS

| | | | |
|---|---|---|---|
| AT | 508 262 | A4 | 12/2010 |
| CA | 2 779 978 | A1 | 1/2012 |

(Continued)

*Primary Examiner* — Anne Hines
(74) *Attorney, Agent, or Firm* — Harness, Dickey & Pierce, P.L.C.

(57) ABSTRACT

An illumination device (e.g., an electric candle, etc.) generally includes a housing, a flame-shaped head, a light source configured to provide illumination for the flame-shaped head, a wobbler coupled to the flame-shaped head, a support member, and a driving device. The support member is configured to support the wobbler such that the wobbler rests on the support member. The driving device is coupled to the support member and configured to produce a movement of the support member to thereby move the wobbler and the flame-shaped head coupled to the wobbler.

31 Claims, 10 Drawing Sheets

Related U.S. Application Data

(60) Provisional application No. 62/008,281, filed on Jun. 5, 2014.

(51) Int. Cl.
*F21W 121/00* (2006.01)
*F21Y 115/10* (2016.01)

(56) References Cited

U.S. PATENT DOCUMENTS

| | | | | |
|---|---|---|---|---|
| 6,554,443 | B2 | 4/2003 | Fan | |
| 7,159,994 | B2 | 1/2007 | Schnuckle et al. | |
| 7,261,455 | B2 | 8/2007 | Schnuckle et al. | |
| 7,556,408 | B2 | 7/2009 | Thomson | |
| 7,686,471 | B2 | 3/2010 | Reichow | |
| 7,837,355 | B2 | 11/2010 | Schnuckle | |
| 8,070,319 | B2 | 12/2011 | Schnuckle et al. | |
| 8,132,936 | B2 | 3/2012 | Patton et al. | |
| 8,342,712 | B2 | 1/2013 | Patton et al. | |
| 8,534,869 | B2 | 9/2013 | Patton et al. | |
| 8,550,660 | B2 | 10/2013 | Patton et al. | |
| 8,628,223 | B2 | 1/2014 | Kwok et al. | |
| 8,646,946 | B2 | 2/2014 | Schnuckle et al. | |
| 8,696,166 | B2 | 4/2014 | Patton et al. | |
| 8,721,118 | B2 | 5/2014 | Patton et al. | |
| 8,727,569 | B2 | 5/2014 | Schnuckle et al. | |
| 8,777,465 | B2 | 7/2014 | Patton et al. | |
| 8,789,986 | B2 | 7/2014 | Li | |
| 8,926,137 | B2 | 1/2015 | Li | |
| 9,574,748 | B2 | 2/2017 | Dong | |
| 2004/0114351 | A1 | 6/2004 | Stokes et al. | |
| 2005/0225984 | A1 | 10/2005 | Theobald | |
| 2007/0223216 | A1 | 9/2007 | Jensen et al. | |
| 2008/0151571 | A1 | 6/2008 | Chen | |
| 2010/0079999 | A1 | 4/2010 | Schnuckle | |
| 2010/0188859 | A1 | 7/2010 | Zhao | |
| 2011/0127914 | A1 | 6/2011 | Patton et al. | |
| 2011/0204828 | A1 | 8/2011 | Moody | |
| 2012/0134157 | A1 | 5/2012 | Li | |
| 2012/0287612 | A1 | 11/2012 | Hau et al. | |
| 2012/0300459 | A1* | 11/2012 | Hau | F21S 10/046 362/249.02 |
| 2013/0088879 | A1 | 4/2013 | Chartrand | |
| 2013/0286642 | A1 | 10/2013 | Patton | |
| 2013/0329406 | A1 | 12/2013 | Lederer | |
| 2014/0098536 | A1 | 4/2014 | Thompson | |
| 2014/0104812 | A1 | 4/2014 | Patton et al. | |
| 2014/0177212 | A1 | 6/2014 | Li | |
| 2014/0218903 | A1 | 8/2014 | Sheng | |
| 2014/0218929 | A1 | 8/2014 | Schnuckle et al. | |
| 2014/0313694 | A1 | 10/2014 | Patton et al. | |
| 2015/0036348 | A1 | 2/2015 | Dong | |
| 2016/0146414 | A1 | 5/2016 | Dong | |
| 2016/0153630 | A1 | 6/2016 | Dong | |

FOREIGN PATENT DOCUMENTS

| | | | |
|---|---|---|---|
| CN | 201047546 | U | 4/2008 |
| CN | 201724143 | U | 1/2011 |
| CN | 101865413 | B | 8/2012 |
| CN | 202469608 | U | 10/2012 |
| CN | 102853368 | A | 1/2013 |
| CN | 202791780 | U | 3/2013 |
| CN | 201320180832.9 | | 7/2013 |
| CN | 201320547507.X | | 8/2013 |
| CN | 201320711701.7 | | 11/2013 |
| CN | 203375334 | U | 1/2014 |
| CN | 203442498 | U | 2/2014 |
| CN | 203571616 | U | 4/2014 |
| CN | 201420165185.7 | | 4/2014 |
| CN | 203642063 | U | 6/2014 |
| CN | 203784814 | U | 8/2014 |
| CN | 204005707 | U | 12/2014 |
| DE | 10 2007 014 689 | A1 | 10/2007 |
| DE | 20 2009 018 453 | U1 | 6/2011 |
| DE | 21 2011 100 014 | U1 | 5/2012 |
| DE | 20 2012 102 347 | U1 | 9/2012 |
| DE | 20 2012 104 217 | U1 | 1/2013 |
| DE | 20 2013 101 955 | U1 | 7/2013 |
| DE | EP 2 644 970 | A1 | 10/2013 |
| DE | 20 2014 100 821 | U1 | 4/2014 |
| EP | 0 138 786 | B1 | 4/1985 |
| EP | 0 826 129 | A1 | 3/1998 |
| EP | 1 496 306 | A2 | 1/2005 |
| EP | 2 278 211 | A1 | 1/2011 |
| EP | WO 2012/000418 | A1 | 1/2012 |
| EP | 2 546 571 | A1 | 1/2013 |
| EP | 2 232 128 | B1 | 2/2013 |
| EP | 2 565 518 | A1 | 3/2013 |
| EP | 2 454 521 | B1 | 5/2013 |
| EP | 2 587 127 | A1 | 5/2013 |
| EP | 2 715 223 | A1 | 4/2014 |
| EP | 2 833 051 | A1 | 2/2015 |
| EP | 2 833 051 | B1 | 4/2017 |
| GB | 1164144 | | 9/1969 |
| GB | 2 404 730 | A | 2/2005 |
| JP | 3148132 | U | 1/2009 |
| JP | 2012-89462 | A | 5/2012 |
| WO | WO 96/25624 | | 8/1996 |
| WO | WO 2012/162538 | A1 | 11/2012 |
| WO | WO 2013/089401 | A1 | 6/2013 |
| WO | WO 2013/186875 | A1 | 12/2013 |
| WO | WO 2013/189187 | A1 | 12/2013 |
| WO | WO 2015/015346 | A2 | 2/2015 |
| WO | WO 2016/151414 | A1 | 9/2016 |

* cited by examiner

ILLUMINATION DEVICES

CROSS-REFERENCE TO RELATED APPLICATIONS

This application is a continuation-in-part of U.S. patent application Ser. No. 14/328,954 filed on Jul. 11, 2014, which claims the benefit of, and priority to, Chinese Application No. 201320480832.9 filed Jul. 30, 2013, Chinese Application No. 201320547507.X filed Aug. 28, 2013, Chinese Application No. 201320711701.7 filed Nov. 12, 2013, Chinese Application No. 201420165185.7 filed Apr. 4, 2014, and U.S. Provisional Application No. 62/008,281 filed Jun. 5, 2014. This application also claims the benefit of, and priority to, Chinese Application No. 201510128281.3 filed Mar. 23, 2015. The entire disclosures of each of the above applications are incorporated herein by reference.

FIELD

The present disclosure generally relates to illumination devices and, more particularly, to illumination devices such as flameless electric candles, etc.

BACKGROUND

This section provides background information related to the present disclosure which is not necessarily prior art.

Conventional candles are typically constructed from wax and include wicks embedded therein. In use of the candles, the wicks can be ignited to produce flames that provide heat, light, etc.

SUMMARY

This section provides a general summary of the disclosure, and is not a comprehensive disclosure of its full scope or all of its features.

Exemplary embodiments of the present disclosure generally relate to illumination devices (e.g., electric candles, etc.). In one exemplary embodiment, an illumination device generally includes a housing, a flame-shaped head, a light source configured to provide illumination for the flame-shaped head, a wobbler coupled to the flame-shaped head, a support member configured to support the wobbler such that the wobbler rests on the support member, and a driving device coupled to the support member and configured to move the support member (e.g., relative to the driving device, etc.) to thereby move the wobbler and the flame-shaped head coupled to the wobbler.

In another exemplary embodiment, an illumination device generally includes a housing, a flame-shaped head, a light source configured to provide illumination for the flame-shaped head to thereby provide a flame effect, a wobbler coupled to the flame-shaped head, a support member configured to support the wobbler, and a driving device coupled to the support member and configured to rotate the support member about a rotation axis generally parallel to a longitudinal axis of the support member to thereby move the wobbler and the flame-shaped head coupled to the wobbler.

In another exemplary embodiment, an illumination device generally includes a housing, a flame-shaped head, a light source configured to provide illumination for the flame-shaped head to thereby provide a flame effect, a wobbler coupled to the flame-shaped head, and a support member configured to support the wobbler such that the wobbler rests on the support member where the support member is configured to rotate eccentrically relative to the wobbler to thereby cause the wobbler and the flame-shaped head to move.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
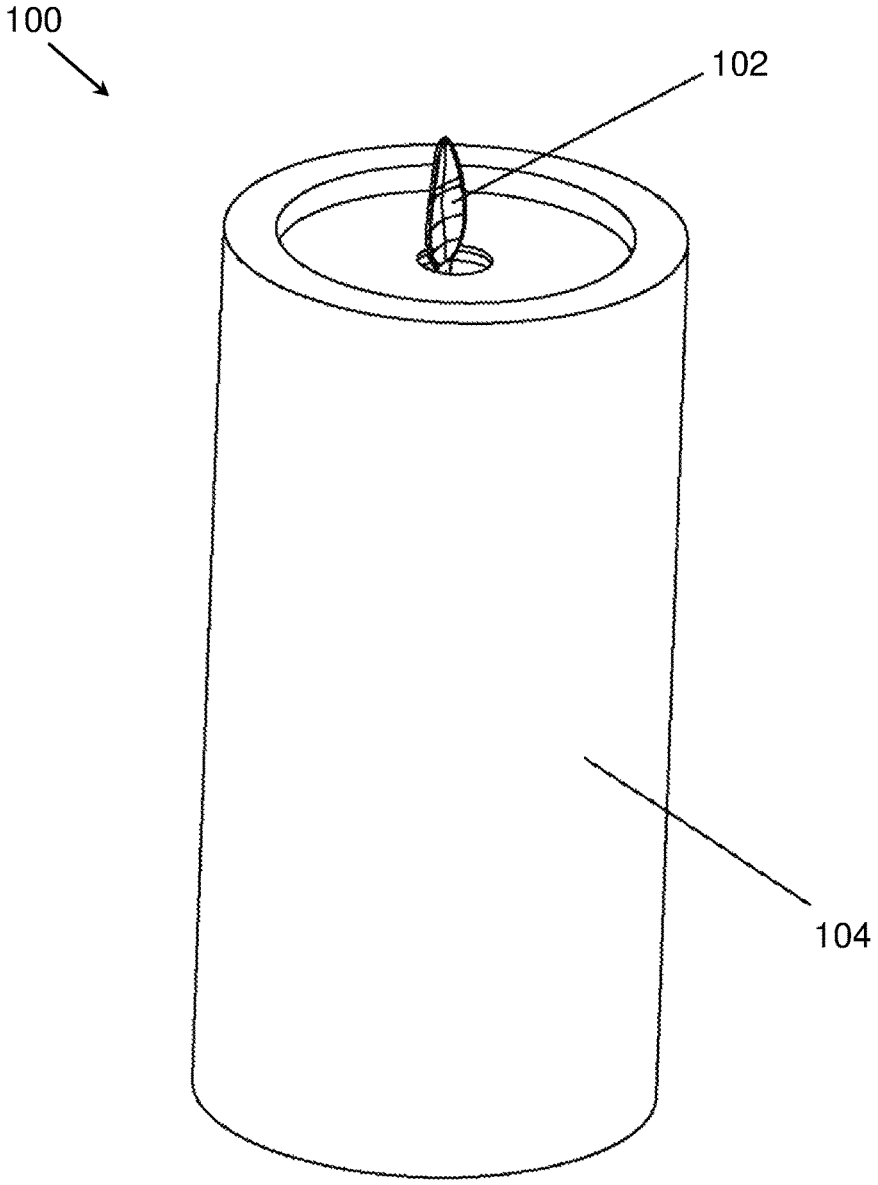
FIG. 1 is a perspective view of an exemplary embodiment of an illumination device according to the present disclosure.

The inventor hereof has developed, and discloses herein, exemplary embodiments of illumination devices. In various aspects, the illumination devices generally include electric candles. But it should be appreciated that the illumination devices may include devices other than the electric candles within the scope of the present disclosure (e.g., the devices may take forms other than candles, etc.).

Exemplary embodiments of the illumination devices generally include housings (e.g., outer portions, external portions, housings, covers, etc.), light sources (e.g., light emitting diode (LED) lights, etc.), flame-shaped heads (e.g., fins, reflectors, three-dimensional shape heads, etc.), wobblers (e.g., domes, covers, shrouds, hoods, or caps, etc. that are configured to wobble, shake, rock, sway, waddle, jiggle, or teeter, etc.), support members (e.g., pillars, columns, etc.), and driving devices (e.g., motors, etc.). In some aspects, the flame-shaped heads are coupled to the wobblers (or integrally formed with the wobblers), and the support members support the wobblers and are configured to move to cause wobbling of the wobblers (and the flame-shaped heads) relative to the housings. The support members are coupled to (e.g., fixed on, integrated with, attached to, snap-fit to, welded with, etc.) the driving devices. And, the driving devices (which may include, without limitation, motors (e.g., vibrating motors, polarizing motors, etc.); magnetic assemblies; pressure differentials; other motion driving devices, etc.) are configured to produce the movement of the support members.

In some aspects, the wobblers of the illumination devices are configured to sit or rest on the support members, without being physically attached thereto. In addition, in some aspects the support members may include support members having rotational axes parallel with and off-set from rotational drive axes of the driving devices. As such, when the driving devices operate (e.g., rotate drive shafts, etc.), the support members may revolve around the axes of the motors creating a slight wobbling of the wobblers sitting on the support members.

In some aspects, the wobblers may be designed as cones with tapered inner top apexes. The tapered inner top apexes have smooth transitions. As such, the support members, when supporting the wobblers, may be configured to touch and support the wobblers at the tapered inner top apexes via tip portions of the support members such that the wobblers may wobble while the support members rotate with the driving devices, thereby moving (e.g., swinging, flickering, oscillating, or swaying, etc.) the coupled flame-shaped heads.

In some aspects, the illumination devices may include assemblies configured to limit the movements of the wobblers, such that the wobblers do not spin off the support members. The assemblies may include cords extending between holders that are coupled within the housings.

In some aspects, the flame-shaped heads of the illumination devices are flame-shaped fins configured to reflect and/or transmit light received from light sources disposed within the housings. In other aspects, the light sources of the illumination devices may be disposed within three-dimensional flame-shaped heads so that light from the light sources can be, at least partly, transmitted through the flame-shaped heads to provide a flame effect.

In addition, in some aspects the illumination devices further include color elements positioned over at least part of the light sources (and, in some cases, positioned within the heads (although they may alternatively be positioned outside of the heads in some embodiments, or may be formed integrally with the heads in some embodiments)) for creating a color effect in connection with the flame effect. The color elements may include any suitable shapes, including, without limitation, tube-shaped sleeves, rings, lampshade shapes, etc. In addition, the color elements may include desired colors, for example, generally blue colors or other colors (e.g., orange and/or red colors, etc.). Further, the color elements may be transparent, translucent, etc. and/or may be made of any suitable material such as plastic, rubber, silicon, glass, etc.

Additionally, in various aspects, the illumination devices use printed circuit boards (PCBs), which generally contain conductive paths, lines, traces, or pads, etc. to electrically connect (and/or power and/or control) the light sources and/or the driving devices, to thereby control operation of the light sources and/or the driving devices. In some aspects, the PCBs may further include (e.g., are part of, are associated with, etc.) and/or contain electronic components (e.g., resistors, capacitors, diodes, transistors, etc.) in addition to electrical wirings. And, in some aspects, at least two wires are used to electrically connect the PCBs to the light sources. In addition, due to the generally small size of the wires, each of the at least two wires may include lacquered wires, or metal wires without any coating (e.g. without plastic or rubber outer layers).

With reference now to the drawings, FIGS. 1-7 illustrate an exemplary embodiment of an illumination device 100 including one or more aspects of the present disclosure. In this embodiment, the illumination device 100 is illustrated as an electric candle. However, it should be appreciated that the illumination device 100 may have other configurations, other than electric candles, in other embodiments.

As shown in FIG. 1, the illumination device 100 generally includes a flame-shaped head 102 and a housing 104. The flame-shaped head 102 is located generally above the housing 104 and is configured to move relative to the housing 104 (as will be described in more detail hereinafter).

Figure 2:
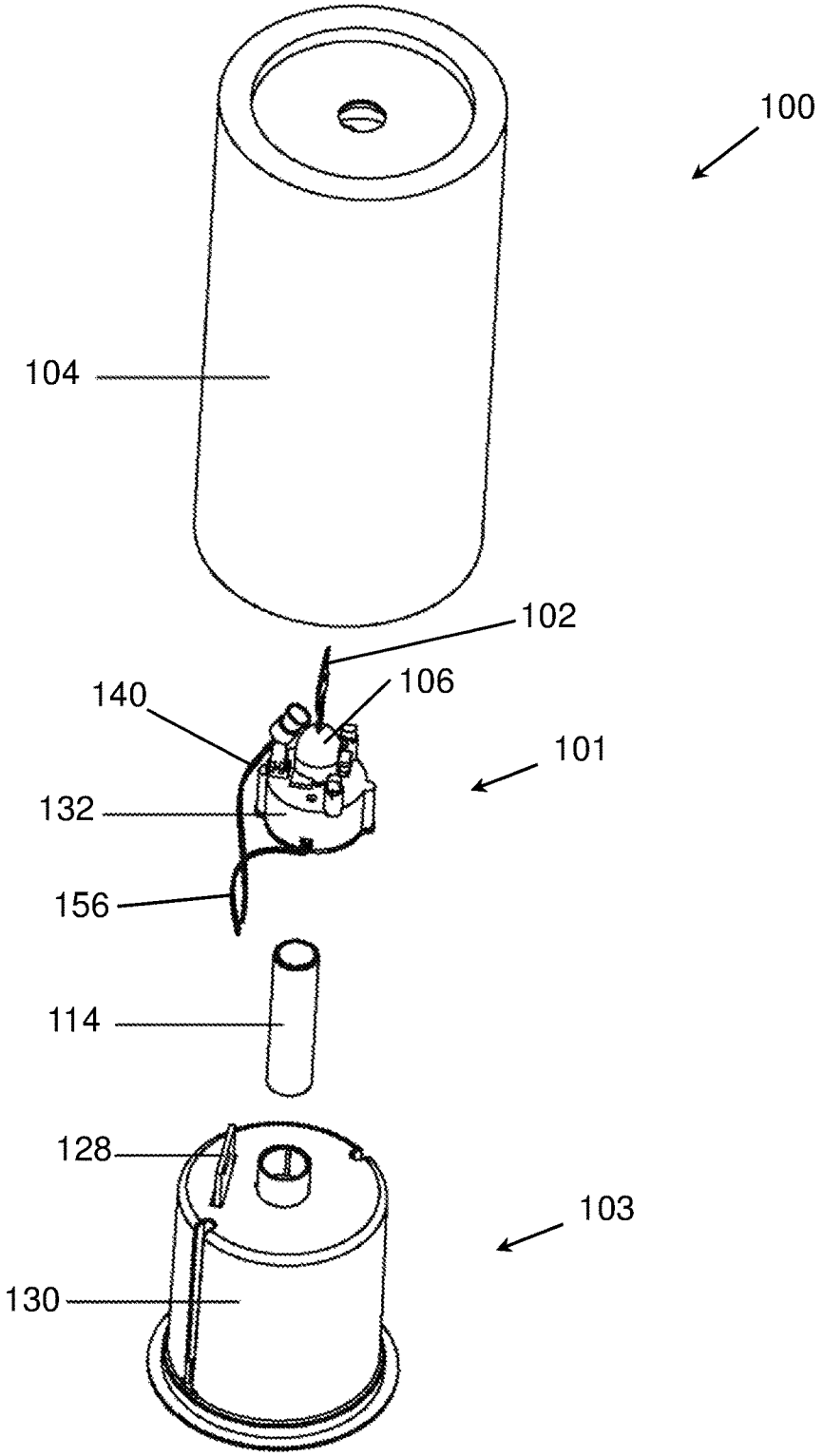
FIG. 2 is an exploded perspective view of the illumination device of FIG. 1.
Figure 3:
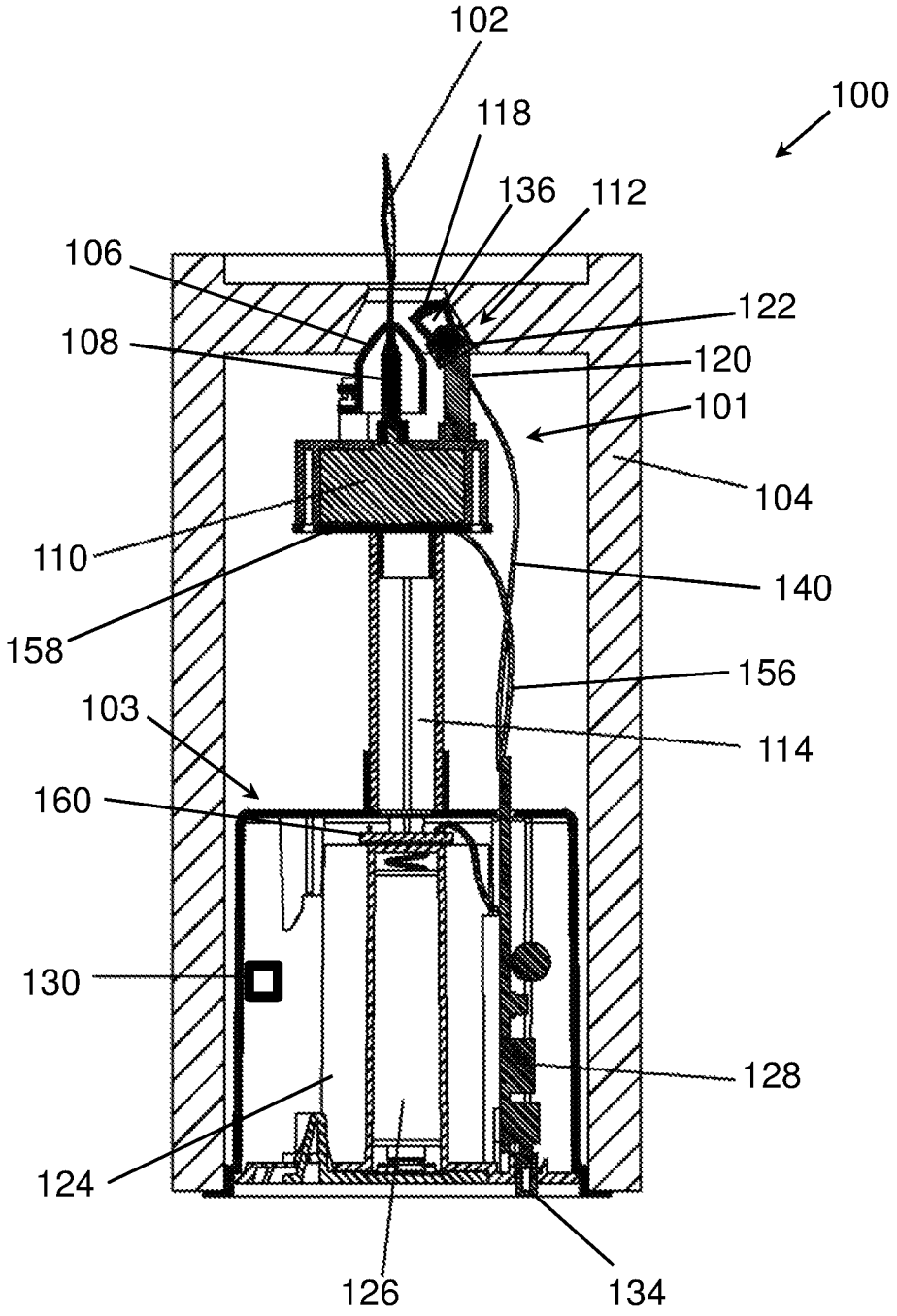
FIG. 3 is a section view of the illumination device of FIG. 1, with portions removed to show internal construction.

With additional reference to FIGS. 2 and 3, the illumination device 100 also includes a functional module 101 and a battery compartment 103. The functional module 101 and the battery compartment 103 are configured to couple to (and be generally disposed within) the housing 104. Batteries 126 (broadly, a power supply) provide power to the illumination device 100 (e.g., to lighting device 112, etc.) via connecting wires 140, and also provide power to a driving device 110 via a power line 156. The batteries 126 are positioned within the battery compartment 103 that is coupled to the housing 104. In addition, the driving device 110 is enclosed (e.g., at least partly enclosed, etc.) by a driving device cover 132, engaged with (and/or supported by) a chassis 158 (such that the driving device 110 does not move, or remains in a generally fixed position in the housing 104, for example, during operation of the illumination device 100).

The functional module 101 of the illumination device 100 generally includes the flame-shaped head 102 coupled to an upper portion of a wobbler 106. The wobbler 106 generally rests on a tip portion 164 (FIG. 7) of a support member 108. And, the support member 108 is coupled to (e.g., fixed on, integrated with, attached to, snap-fit to, welded with, etc.) the driving device 110, generally at a bottom portion of the support member 108.

Figure 6:
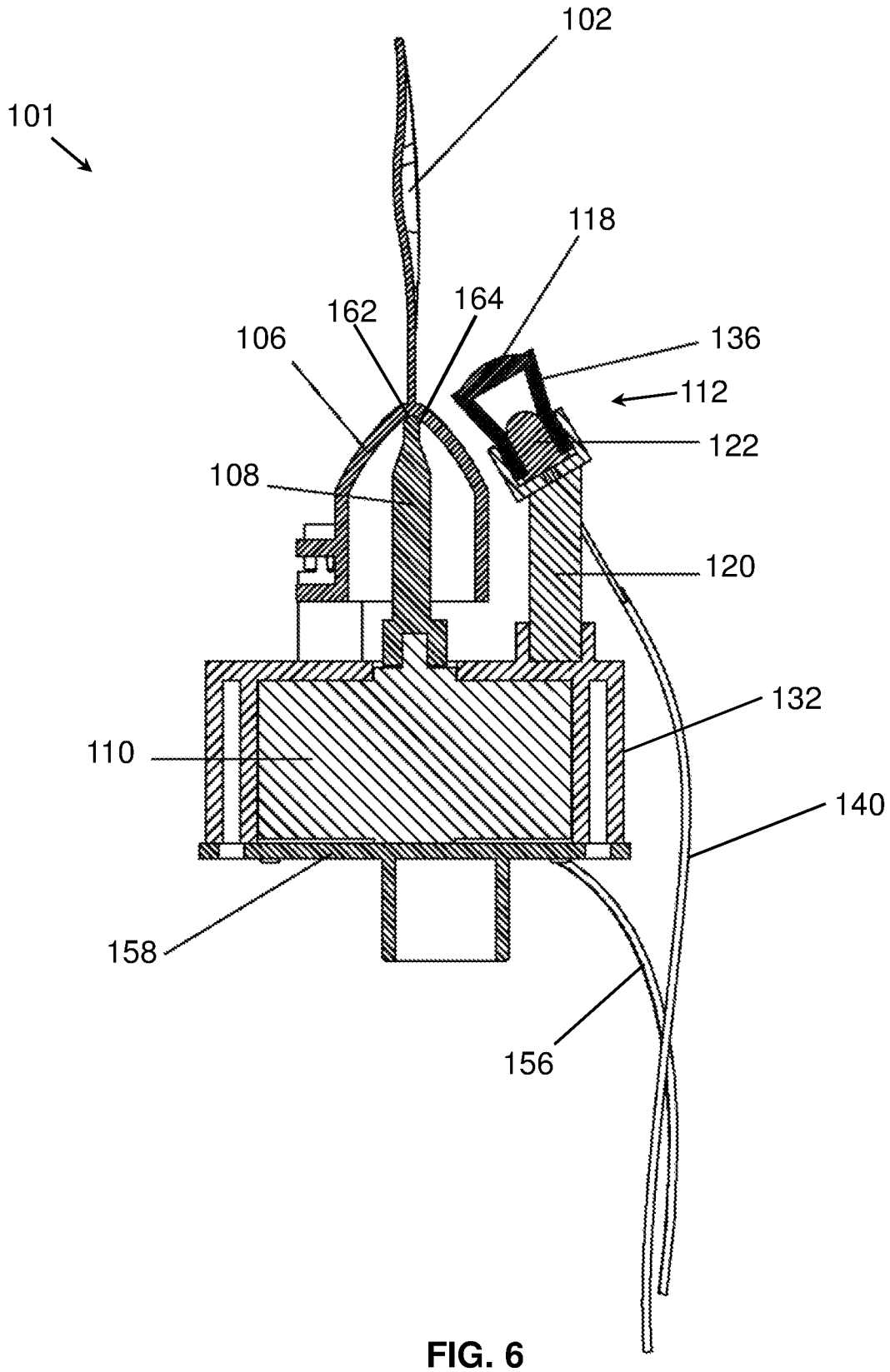
FIG. 6 is a section view of the functional module of the illumination device of FIG. 1, with portions removed to show internal construction.
Figure 7:
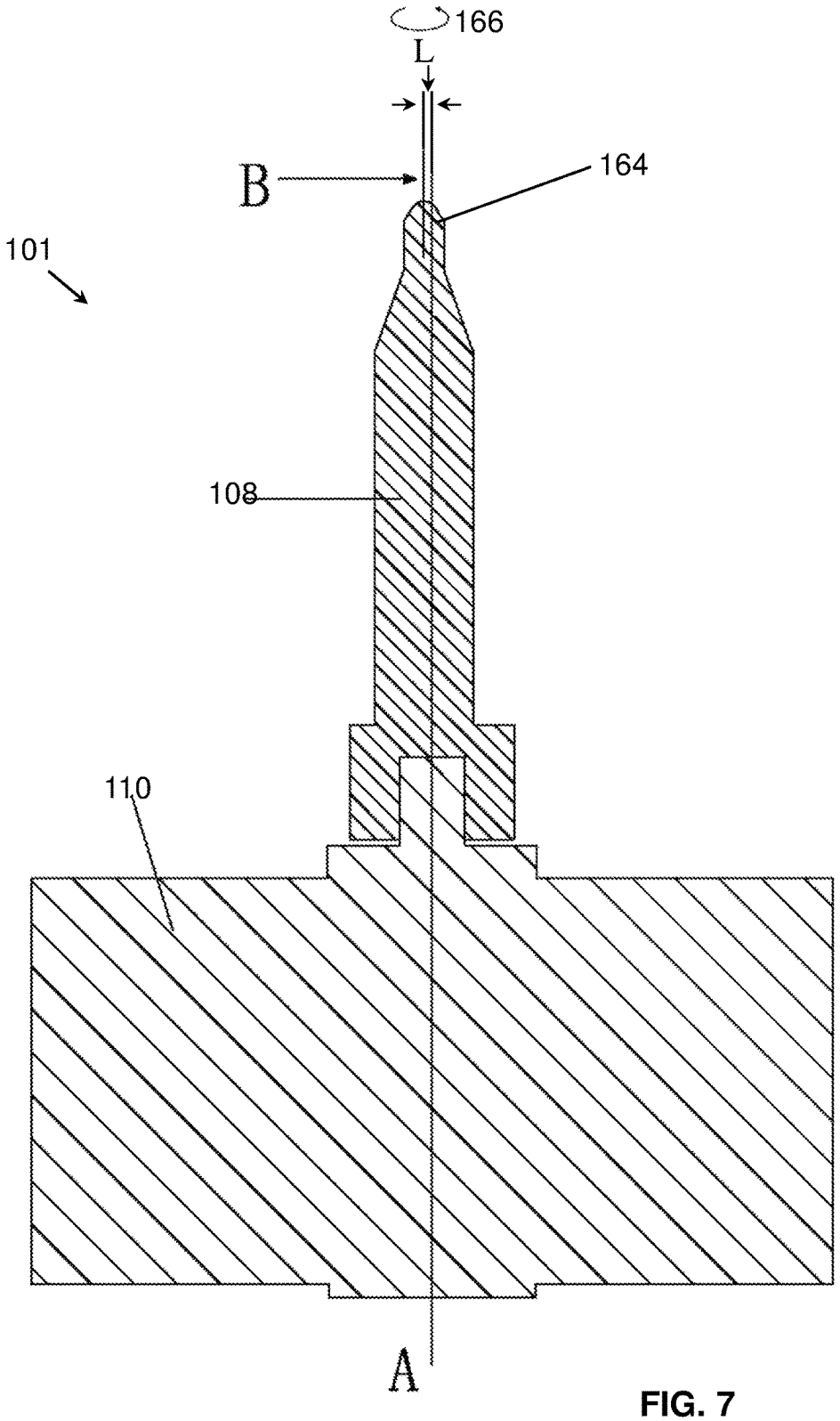
FIG. 7 is a section view of a support member of the functional module of the illumination device of FIG. 1, shown coupled to a motor.

With further reference to FIGS. 6 and 7, the wobbler 106 includes a generally cone-shaped cover having a generally tapered inner top apex 162. The tapered inner top apex 162 may be formed by a smooth transition to the apex 162. The support member 108 supports the wobbler 106 by contact at (but not fixed to and without physical attachment or connection) the tapered inner top apex 162, at the tip portion 164 of the support member 108 (i.e., the wobbler 106 simply rests on the support member 108 in this embodiment). Because the inner top apex 162 includes a generally smooth transition thereacross, the wobbler 106 may wobble (or otherwise move in three different dimensions, for example) more easily as the support member 108 is moved (e.g., is rotated by the driving device 110 as indicated by arrow 166 in FIG. 7) by the driving device 110, thereby moving the coupled flame-shaped head 102 relative to the housing 104 as if the flame-shaped head 102 flickers, oscillates, or wobbles, etc. (broadly, imitating movement of a real flame). With that said, it should be appreciated that in other embodiments the wobbler 106 may be physically attached to the support member 108 (e.g., via a bearing connection, via a ball-and-socket connection, etc.), but may still wobble as described herein (upon movement of the support member 108 by the driving device 110).

Referring now to FIGS. 2-5, the functional module 101 connects to the battery compartment 103 via a support column 114. Specifically, the chassis 158 is coupled to (e.g., is fixed on, is integrated with, is attached to, is snap-fit to, is welded with, etc.) an upper portion of the support column 114, and the battery compartment 103 is coupled to (e.g., is fixed on, is integrated with, is attached to, is snap-fit to, is welded with, etc.) an opposite end portion of the support column 114 within the housing 104.

Figure 5:
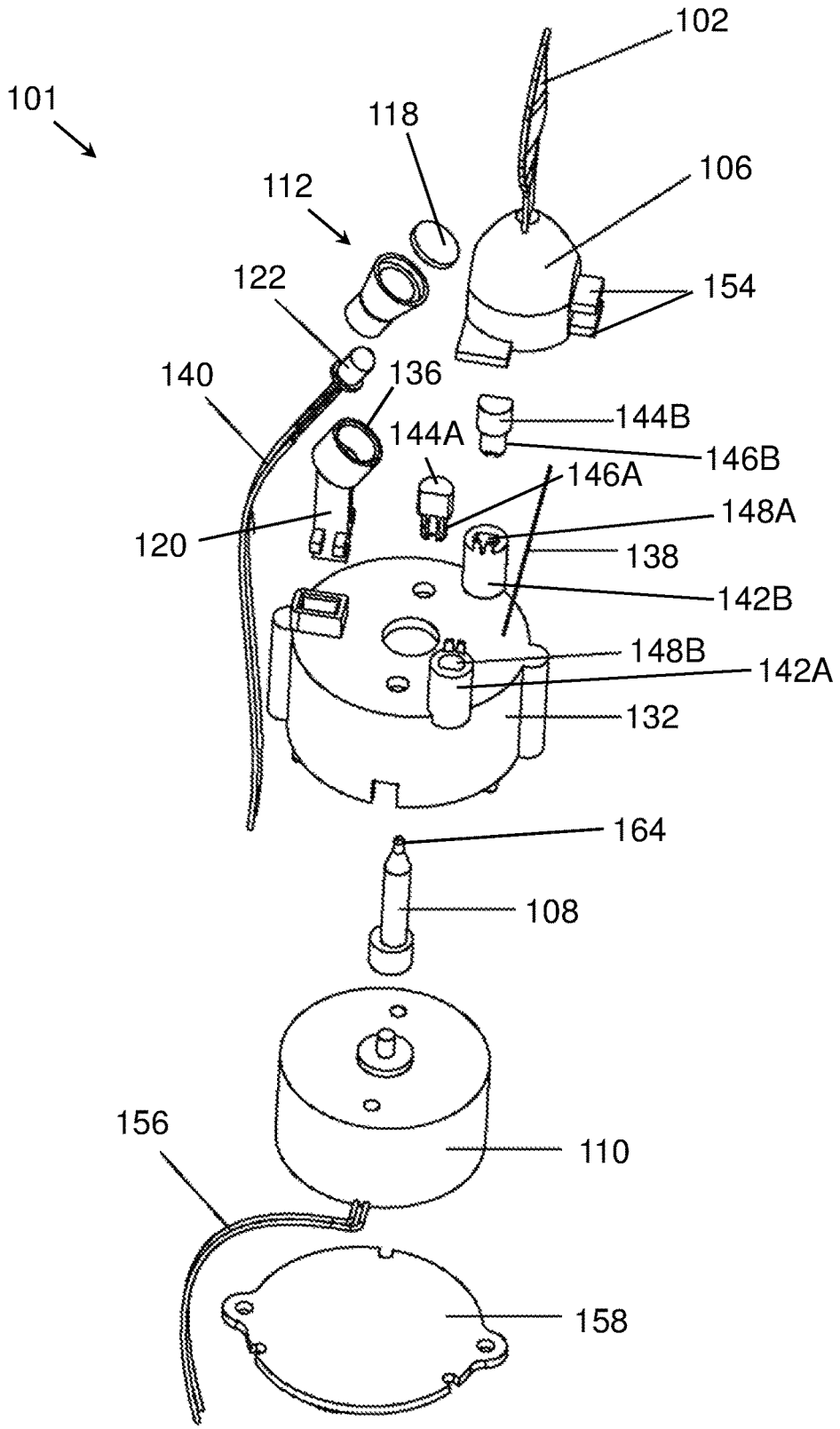
FIG. 5 is an exploded perspective view of a functional module of the illumination device of FIG. 1.

The flame-shaped head 102 associated with the functional module 101 is generally designed as (or to imitate) a burning flame-shaped head. The lighting device 112 of the functional module 101 is then located within the housing 104 to illuminate the flame-shaped head 102 (e.g., as the flame-shaped head 102 moves with the wobbler 106, etc.). In particular, the lighting device 112 may operate to project light onto a surface of the flame-shaped head 102, which may then be reflected from and/or transmitted through the flame-shaped head 102 to generate a flame effect. As best seen in FIG. 5, the lighting device 112 includes an optical lens 118, a light source 122 (e.g., an LED light source, or any other suitable type of light source, etc.), and a focusing lens holder 136. The light source 122 is positioned and/or secured within the focusing lens holder 136 (and supported by a light source mounting bracket 120). The optical lens 118 is mounted at the opening of the focusing lens holder 136, facing toward the flame-shaped head 102. The light transmits from the light source 122 through the converging optical lens 118 and projects onto the surface of the flame-shaped head 102. In general, the lighting device 112 may be viewed as mounted on the light source mounting bracket 120.

Additionally, a color element (not shown) may be positioned over the light source 122. When such a color element is present, the light source 122 may transmit light through the color element to create a color effect at the flame-shaped head 102 in connection with the flame effect of the illumination device 100.

Figure 4:
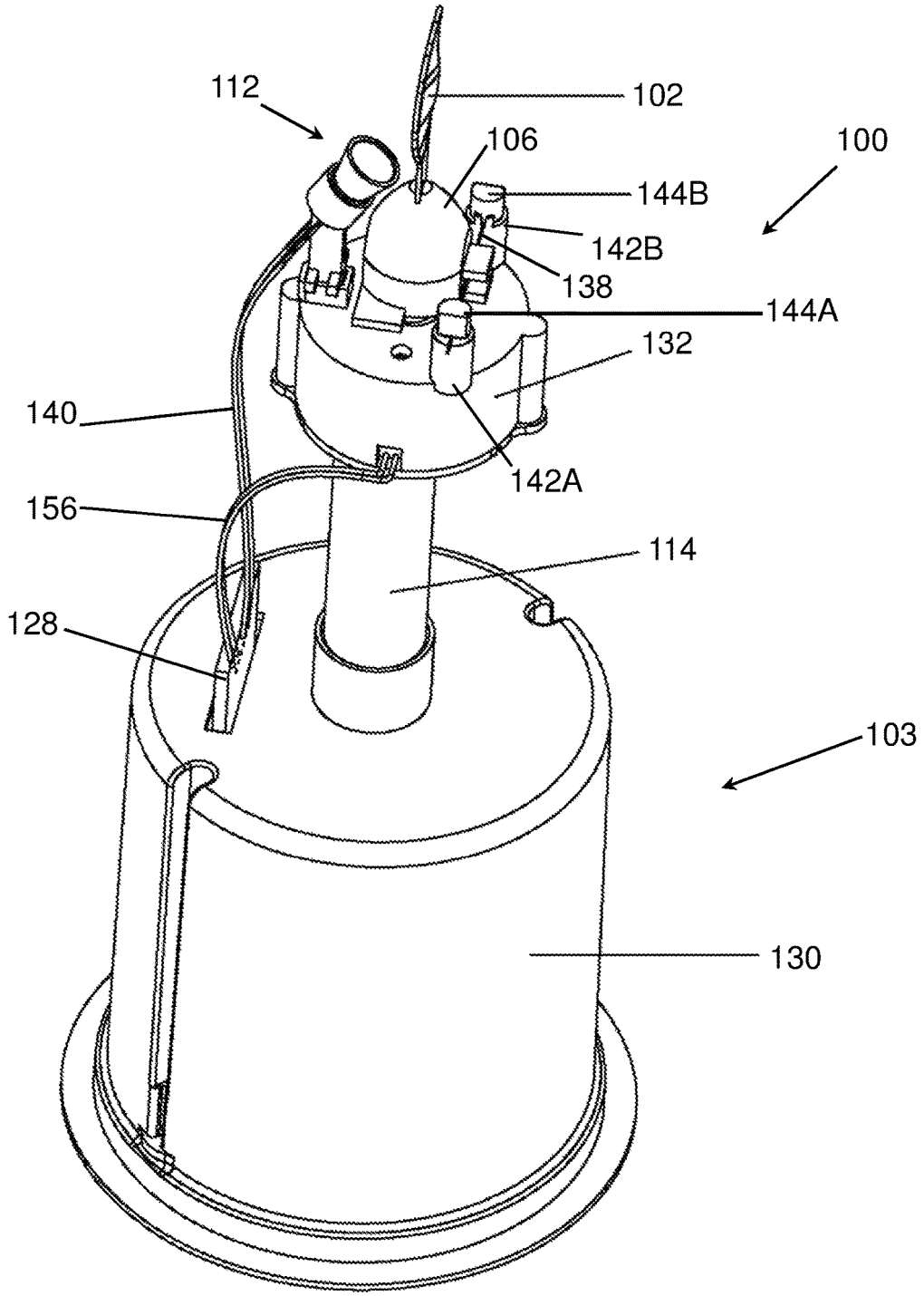
FIG. 4 is a perspective view the illumination device of FIG. 1, with a housing of the illumination device removed.

The light source 122 of the lighting device 112 (of the functional module 101) is connected to a PCB 128 (broadly, a control unit) with the connecting wires 140 (as best seen in FIG. 4). The PCB 128 may include a light source control unit (not shown) (broadly, a processing unit) (e.g., an integrated circuit, etc.) that controls the light source 122, for example, causing the light source 122 to flash and vary in intensity with time, thereby creating a flickering flame effect (e.g., in place of or in connection with a flickering LED, etc.).

While the illustrated illumination device 100 includes a single lighting device 112, it should be appreciated that other embodiments of illumination devices may include multiple lighting devices each configured to project light onto surfaces of flame-shaped heads of the illumination devices.

As best seen in FIG. 3, the battery compartment 103 of the illumination device 100 includes a battery cartridge 124, the batteries 126 positioned within the cartridge 124, the PCB 128, and a battery cover 130 coupled to the battery cartridge 124. The battery cover 130 may be provided to cover the components of the battery compartment 103 when the illumination device 100 is assembled. The PCB 128 may be electrically connected to the batteries 126 by connecting wires. The PCB 128 is also be electrically connected to the driving device 110 by connecting wires 156 and to the light source 122 by connecting wires 140. An upper portion of the battery cartridge 124 may be provided with a positive resilient electrode and a lower portion of the battery cartridge 124 may include a negative elastic electrode. The PCB 128 may be electrically connected to the batteries 126 by the positive and negative electrodes. The illustrated PCB 128 also includes a PCB switch 134 (e.g., for activating and/or deactivating the illumination device 100, or for other uses/operations, etc.). The battery cover 130 further includes a connecting plate 160 for connecting multiple batteries 126 in series, as desired.

It should be appreciated that the various coupling mechanisms between the support member 108 and the driving device 110, between the chassis 158 (or functional module 101) and the support column 114, between the support column 114 and the battery compartment 103, and between the light source mounting bracket 120 and the driving device cover 132, may include any appropriate coupling mechanisms (or methods), including, for example, fixtures, interference fits, snap fits, friction fits, mechanical fasteners and/or couplings (including welds), adhesives, etc.

During operation of the illumination device 100, the PCB switch 134 is on and the batteries 126 energize the driving device 110, which then rotates a drive shaft of the driving device 110. The rotating drive shaft is coupled to the support member 108 and causes the support member 108 to rotate with operation of the driving device 110 (and generally relative to the driving device 110, in some embodiments). The rotation of the support member 108, in turn, causes wobbling of the wobbler 106 that rests on the tip portion 164 of the support member 108. Because the wobbler 106 includes the smooth transitions forming the generally tapered inner top apex 162, contact of the wobbler 106 with the tip portion 164 of the support member 108 creates very little resistance. This allows the wobbler 106 to generally rest on the support member 108 and easily move, flicker, wobble, swing, etc. on the support member 108 (without being directly attached to the support member 108). This also helps facilitate movement of the flame-shaped head 102, coupled to the wobbler 106, to be generally slower than the spinning of the support member 108, and also to be generally smoother, less stiff, less rigid, etc. and, thus, more vivid and more realistic as a flame (i.e., these features of the wobbler 106 and the support member 108 generally impart a more vivid and more realistic appearance to the flame-shaped head 102, the effects of the light source 122 on the flame-shaped head 102, and the illumination device 100 in general).

As shown in FIGS. 4 and 5, the illumination device 100 further includes a cord 138 associated with the functional module 101, and configured to restrict (or limit) the wobbling movements of the wobbler 106 and to generally inhibit the wobbler 106 from spinning (or otherwise wobbling) off the support member 108. The cord 138 extends between holders 142A, 142B. In the exemplary illumination device 100, the holders 142A, 142B are illustrated as coupled on the driving device cover 132 generally within the housing 104. However, the holders 142A, 142B may alternatively couple to, for example, inner walls of the housing 104. In either case, the two ends of the cord 138 are then captured (e.g., pinched, etc.) by inserts 144A, 144B, respectively, fitting together with the holders 142A, 142B. For example, by the insertion of tabs 146A, 146B within respective openings 148A, 148B of the holders 142A, 142B (or otherwise by interference fit, snap fit, friction fit, mechanical fasteners, adhesive, etc.), the cord is coupled to the holders 142A, 142B. The cord 138 may extend tightly (e.g., under tension, etc.) between the two holders 142A, 142B (e.g., generally linearly, without sag, without bend, etc.), and may be held in this tight configuration by the end fixations (e.g., by the inserts 144A, 144B in the illustrated embodiment). Thus, the cord 138, when fixed in this position with tension, generally forms a stop that operates to limit (or constrain) movement of the wobbler 106, as desired. As can be appreciated, the cord may be positioned differently relative to the wobbler 106 to provide desired limitations to the movement (e.g., to provide different flame effects in different embodiments, etc.).

In connection with the cord 138, the wobbler 106 of the illumination device 100 includes a pair of protrusions 154 formed on the wobbler 106 and facing the cord 138. The protrusions 154 are configured to receive the cord 138 between each of the protrusions 154 (e.g., within a channel defined by the protrusions 154, etc.). As such, during operation, the wobbler 106 may swing (or wobble) to a position at which the outer side of the wobbler 106 and/or one of the protrusions 154 touches the cord 138 and causes the wobbler 106 to rebound or stop and not swing beyond that position (thereby preventing the wobbler 106 from moving too much, etc.). Such a restrictive configuration may prevent the wobbler 106 from separating from the support member 108 due to large movements, may provide desired flame effects to the illumination device 100, etc.

The cord 138 associated with the functional module 101 may include a soft (non-metallic) thin, pliable cord with sufficient tensile-strength to operate as described herein. As an example, the cord 138 may include a fishing line, etc. The cord 138 may extend tightly (e.g., under tension, etc.) between the two holders 142A, 142B within the housing 104 (e.g., generally linearly, without sag, without bend, etc.), and may be held in this tight configuration by the ends of cord 138 mounted between the inserts 144A, 144B and the holders 142A, 142B. The mounted cord 138, in this manner, provides enough strength to stop or deflect the moving wobbler 106, without breaking, when the wobbler 106 contacts and strikes the cord 138. In addition, the generally thin and pliable nature of the illustrated cord 138 may also reduce or eliminate impact noise generated by the contacting/striking operation (particularly where such operation is continuously repeated, etc.). As such, an exemplary restriction assembly may be viewed as being configured by the cord 138, the holders 142A-B with openings 148A-B, the inserts 144A-B with taps 146A-B, and the protrusion 154 to limit the movement of the wobbler 106 (e.g., preventing the wobbler 106 from separating from the support member 108, etc.).

While the illustrated illumination device 100 includes a single cord 138, it should be appreciated that other embodiments of illumination devices may include multiple cords, each configured to be positioned (e.g., about the wobbler 108, etc.) to limit the movement of the wobbler 106 from various directions.

With reference again to FIG. 7, the driving device 110 of the illumination device 100 includes a rotation axis A (e.g., about which the drive shaft of the driving device 110 rotates, etc.) parallel to but not coaxial with (or that does not coincide with) a central symmetrical axis B (e.g., a longitudinal axis, etc.) of the support member 108. For example, in the illustrated embodiment, the central symmetrical axis B of the support member 108 deviates from the rotation axis A of the driving device 110 by a distance L. Thus, when the driving device 110 spins in a rotation direction 166, the support member 108 coupled to the driving device 110 (at the drive shaft) revolves around the axis A, thereby eccentrically creating a slight wobble in the movement of the wobbler 106 sitting on the support member 108 (see also FIG. 6). As such, the flame-shaped head 102 coupled to the wobbler 106 may wobble irregularly (e.g., irregularly move in three dimensions, etc.) relative to the housing 104, creating vivid, realistic, and non-rigid movements of the flame-shaped head 102 (to thereby mimic an appearance of a real flame).

It should be appreciated that various different distances L between the rotation axis A of the driving device 110 and the central symmetrical axis B of the support member 108 may be configured for the illumination device 100, as desired. For example, a larger distance L may allow for larger wobbling movement of the flame-shaped head 102 along with the coupled wobbler 106, while a smaller distance L may yield a smaller wobbling movement of the flame-shaped head 102 along with the coupled wobbler 106. Furthermore, the distance L can be configured to be adjustable in the illumination device 100 by utilizing an adjustable attachment assembly between the support member 108 and the driving device 110. For example, a sliding lock, a snap fit fixture with multiple slots, etc. may be provided to allow for adjusting the support member 108 relative to the driving device 110 to thereby manipulate the distance L, as desired (or to potentially adjust the drive shaft of the driving device 110, etc.).

Figure 8:
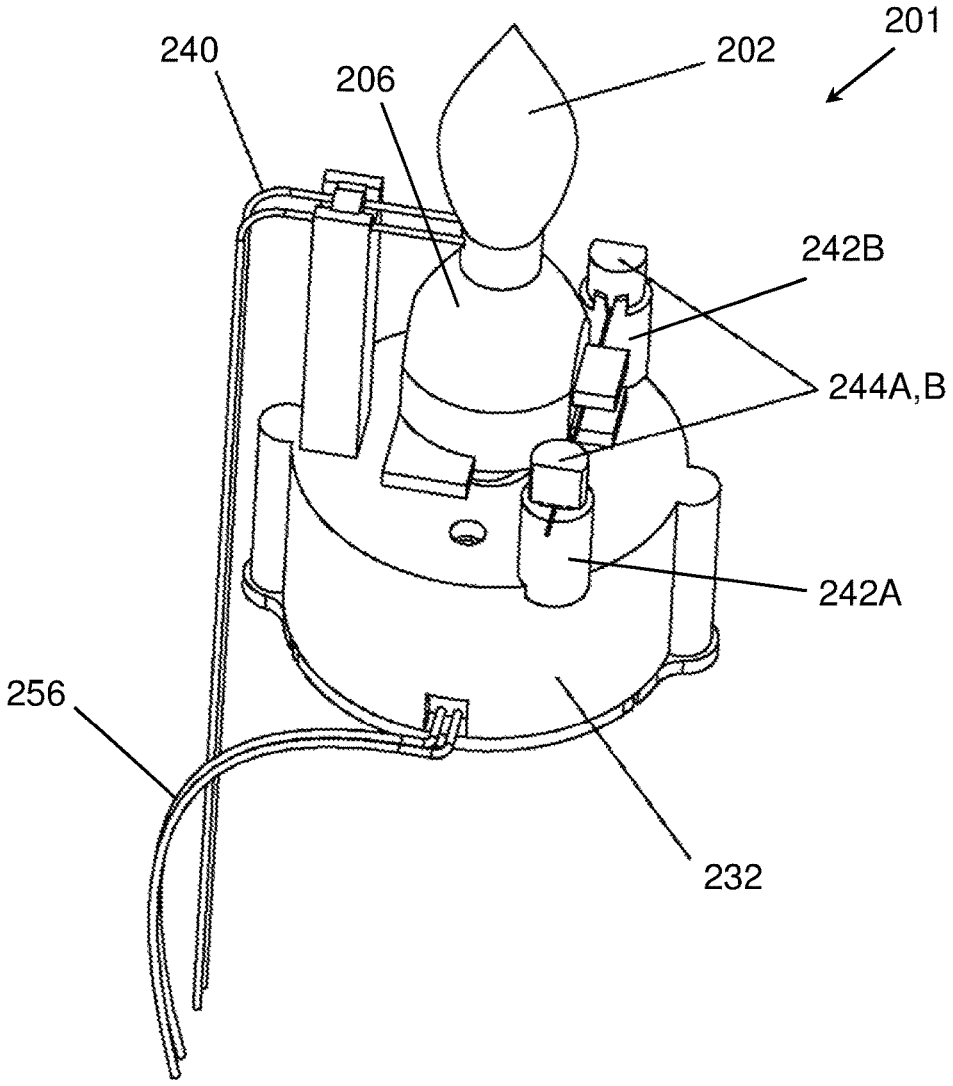
FIG. 8 is a perspective view of another exemplary embodiment of a functional module suitable for use in illumination devices of the present disclosure.
Figure 9:
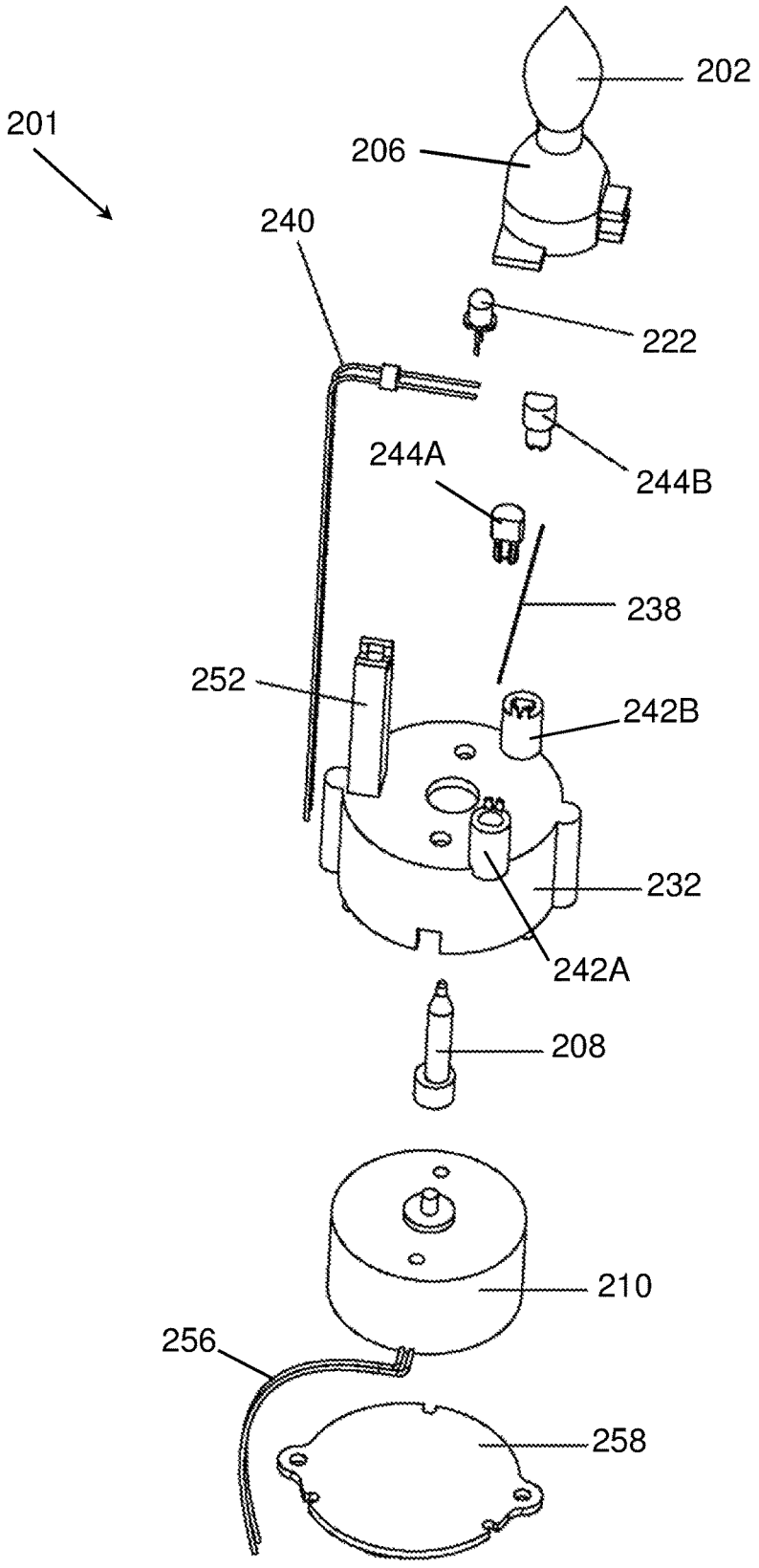
FIG. 9 is an exploded perspective view of the functional module of FIG. 8.
Figure 10:
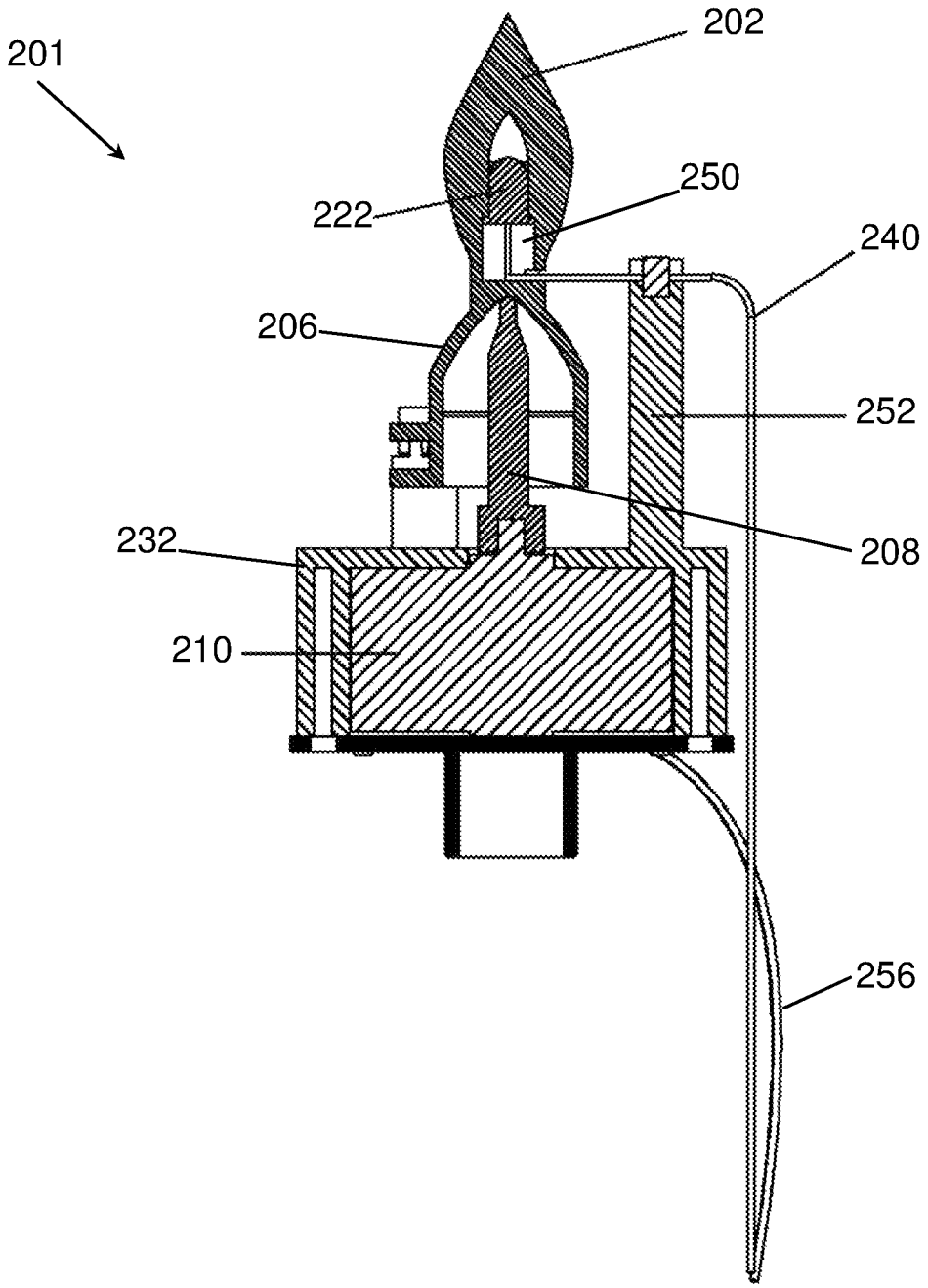
FIG. 10 is a section view of the functional module of FIG. 8, with portions removed to show internal construction.

FIGS. 8-10 illustrate another exemplary embodiment of a functional module 201 including one or more aspects of the present disclosure and suitable for use in an electric candle (e.g., in the illumination device 100; in other illumination devices of the present disclosure; in other illumination devices; etc.). In this embodiment, the functional module 201 is again illustrated as part of an electric candle. However, it should be appreciated that the functional module 201 may be provided in other configurations, other than electric candles, in other embodiments.

The functional module 201 of this embodiment is similar to the functional module 101 of the illumination device 100 previously described and illustrated in FIGS. 1-7. In addition, the various components of the functional module 201 described below and illustrated in the drawings can achieve similar technical results to the corresponding components of the functional module 101. For example, the functional module 201 generally includes a flame-shaped head 202 coupled to an upper portion of a wobbler 206 (although the flame shaped head 202 is configured differently, as will be described). In addition, the wobbler 206 rests on a tip portion of a support member 208. And, the support member 208 is coupled to (e.g., fixed on, integrated with, attached to, snap-fit to, welded with, etc.) a drive shaft of a driving device 210, at its bottom portion, to thereby facilitate rotating movement of the support member 208 and wobbling movement of the wobbler 206 (in generally the same manner as described for the illumination device 100). Moreover, the driving device 210 may be powered by batteries via a power line 256, and is generally enclosed by a driving device cover 232 engaged with (or coupled to) a chassis 258.

Further, the functional module 201 of this embodiment includes a cord 238 configured to limit the wobbling movements of the wobbler 206, for example, to inhibit the wobbler 206 from becoming detached from support member 208, etc. The cord 238 may extend between holders 242A, 242B coupled to the driving device cover 232 and may be held in a tight configuration by the ends of the cord 238 mounted between inserts 244A, 244B and the holders 242A, 242B (again, in a similar manner as described for the illumination device 100).

In this embodiment, the functional module 201 includes a light source 222 disposed within the flame-shaped head 202. The light source 222 is connected to a PCB with connecting wires 240 (similar to the PCB 128) and is powered by batteries. In particular, the light source 222 is received within a fixture 250 (FIG. 10) coupled to the wobbler 206 (e.g., the light source may be snap-fit to the light source fixture 250, etc.). As such, the light source 222 and the flame-shaped head 202 both couple to, and wobble with, the wobbler 206 during operation of the functional module 201. In addition, the light source 222 transmits light, outwardly, through the flame-shaped head 202 providing a flame effect (e.g., a flame-shaped light, a flame-shaped lighting effect, a flame-colored light, etc.) to the functional module 201.

Also in this embodiment, the functional module 201 includes a wire bracket 252 coupled to (e.g., fixed on, integrated with, attached to, snap-fit to, welded with, etc.) the driving device cover 232. A top portion of the wire bracket 252 may assist in aligning the connecting wires 240 with the fixture 250. The top portion may include one or more grooves or slots to receive the connecting wires 240 to thereby guide and support the connecting wires 240. Thus, when the light source 222 moves with the wobbler 206, the wire bracket 252 helps inhibit the connecting wires 240 from tangling, etc.

Exemplary embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific dimensions, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular exemplary embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally," "about," and "substantially," may be used herein to mean within manufacturing tolerances. Or for example, the term "about" as used herein when modifying a quantity of an ingredient or reactant of the invention or employed refers to variation in the numerical quantity that can happen through typical measuring and handling procedures used, for example, when making concentrates or solutions in the real world through inadvertent error in these procedures; through differences in the manufacture, source, or purity of the ingredients employed to make the compositions or carry out the methods; and the like. The term "about" also encompasses amounts that differ due to different equilibrium conditions for a composition resulting from a particular initial mixture. Whether or not modified by the term "about," the claims include equivalents to the quantities.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another element, component, region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

With that said, the foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An illumination device, comprising:

a housing;

a flame-shaped head;

a light source configured to provide illumination for the flame-shaped head;

a wobbler coupled to the flame-shaped head and comprising a tapered inner apex, at least a portion of the wobbler disposed within the housing;

a support member configured to support the wobbler, such that the wobbler rests on the support member, the support member including a tip portion configured to contact the tapered inner apex of the wobbler when the wobbler rests on the support member; and a driving device coupled to the support member and configured to move the support member, to thereby move the wobbler and the flame-shaped head coupled to the wobbler.

2. The device of claim 1, wherein the driving device comprises a motor configured to rotate a drive shaft coupled to the support member, to thereby rotate the support member and cause the wobbler to move.

3. The device of claim 2, wherein the motor comprises a rotation axis parallel to but not coaxial with a central symmetrical axis of the support member, such that the support member revolves around the rotation axis eccentrically when the motor rotates the drive shaft;

whereby the movement of the wobbler includes a wobbling movement in three different dimensions.

4. The device of claim 3, wherein a distance between the rotation axis of the motor and the central symmetrical axis of the support member is adjustable.

5. The device of claim 1 further comprising a restriction assembly configured to restrict the movement of the wobbler.

6. The device of claim 5, wherein the restriction assembly includes a cord disposed within the housing and configured to form a stop to restrict the movement of the wobbler.

7. The device of claim 6, wherein the cord comprises a non-rigid material.

8. The device of claim 1, wherein the light source is disposed within the housing and is positioned to project light onto a surface of the flame-shaped head to thereby provide illumination for the flame-shaped head; and wherein the flame-shaped head is configured to reflect and/or transmit the projected light to thereby provide a flame effect.

9. The device of claim 1, wherein the light source is disposed within the flame-shaped head, to thereby provide illumination for the flame-shaped head.

10. The device of claim 1, further comprising a control unit electrically coupled to the light source and/or the driving device for controlling operation of the light source and/or the driving device.

11. The device of claim 1, wherein the driving device is configured to move the support member, to thereby move the wobbler and the flame-shaped head coupled to the wobbler.

12. An illumination device, comprising:

a housing;

a flame-shaped head;

a light source configured to provide illumination for the flame-shaped head to thereby provide a flame effect;

a wobbler coupled to the flame-shaped head;

a support member configured to support the wobbler; and a driving device coupled to the support member and configured to rotate the support member about a rotation axis generally parallel to a longitudinal axis of the support member, to thereby move the wobbler and the flame-shaped head coupled to the wobbler; wherein the rotation axis of the driving device is parallel to but not coaxial with the longitudinal axis of the support member, such that the support member revolves around the rotation axis eccentrically when the driving device rotates the support member.

13. The device of claim 12, wherein the wobbler comprises a generally tapered inner apex; and wherein the support member includes a tip portion configured to contact the generally tapered inner apex of the wobbler to support the wobbler.

14. The device of claim 12, further comprising at least one cord disposed within the housing and configured to restrict the movement of the wobbler.

15. The device of claim 14, wherein the wobbler defines a channel configured to receive the at least one cord.

16. The device of claim 14, wherein the at least one cord comprises multiple cords configured to restrict the movement of the wobbler from multiple directions.

17. An illumination device, comprising:

a housing;

a flame-shaped head;

a light source configured to provide illumination for the flame-shaped head to thereby provide a flame effect, the light source disposed within the housing and positioned to project light onto a surface of the flame-shaped head to provide illumination for the flame-shaped head, and the flame-shaped head configured to reflect and/or transmit the projected light to provide the flame effect;

a wobbler coupled to the flame-shaped head; and a support member configured to support the wobbler such that the wobbler rests on the support member, the support member configured to rotate eccentrically relative to the wobbler to thereby cause the wobbler and the flame-shaped head to move.

18. The device of claim 17, further comprising a driving device coupled to the support member and configured to rotate the support member about a rotation axis generally parallel to a longitudinal axis of the support member, to thereby cause the eccentric rotation of the support member.

19. An illumination device, comprising:

a housing;

a flame-shaped head;

a light source configured to provide illumination for the flame-shaped head;

a wobbler coupled to the flame-shaped head; and a support member configured to support the wobbler, such that the wobbler rests on the support member, wherein the wobbler includes a generally cone-shaped cover having a tapered inner apex, and wherein the support member includes a portion configured to contact the tapered inner apex of the wobbler when the wobbler rests on the support member.

20. The device of claim 19, wherein the light source is disposed within the housing and is positioned to project light onto a surface of the flame-shaped head to thereby provide illumination for the flame-shaped head; and wherein the flame-shaped head is configured to reflect and/or transmit the projected light to thereby provide a flame effect.

21. The device of claim 19, wherein the light source is disposed within the flame-shaped head, to thereby provide illumination for the flame-shaped head.

22. The device of claim 21, further comprising a color element positioned over at least part of the light source and disposed within the flame-shaped head, for creating a color effect in the flame-shaped head when the light source transmits light through the color element and the flame-shaped head.

23. The device of claim 22, wherein the color element includes a generally translucent and generally tube-shaped sleeve.

24. The device of claim 22, wherein the color element is generally blue in color.

25. The device of claim 19, further comprising a control unit electrically coupled to the light source for controlling operation of the light source.

26. The device of claim 19, further comprising a driving device configured to produce movement of the wobbler and the flame-shaped head coupled to the wobbler.

27. The device of claim 26, wherein the driving device is coupled to the support member and is configured to move the support member, such that the support member moves the wobbler and the flame-shaped head coupled to the wobbler.

28. An illumination device, comprising:

a housing;

a flame-shaped head;

a light source configured to provide illumination for the flame-shaped head;

a wobbler coupled to the flame-shaped head, at least a portion of the wobbler disposed within the housing;

a support member configured to support the wobbler, such that the wobbler rests on the support member; and a driving device coupled to the support member and configured to move the support member, to thereby move the wobbler and the flame-shaped head coupled to the wobbler, the driving device comprising a motor configured to rotate a drive shaft coupled to the support member to thereby rotate the support member and cause the wobbler to move.

29. An illumination device, comprising:

a housing;

a flame-shaped head;

a light source configured to provide illumination for the flame-shaped head;

a wobbler coupled to the flame-shaped head;

a support member configured to support the wobbler;

a driving device coupled to the support member and configured to move the support member, to thereby move the wobbler and the flame-shaped head coupled to the wobbler; and a restriction assembly configured to restrict the movement of the wobbler, the restriction assembly including at least one cord configured to form a stop to restrict the movement of the wobbler.

30. The device of claim 29, wherein the at least one cord comprises multiple cords configured to restrict the movement of the wobbler from multiple directions.

31. An illumination device, comprising:

a housing;

a flame-shaped head;

a light source configured to provide illumination for the flame-shaped head, the light source disposed within the housing and positioned to project light onto a surface of the flame-shaped head to thereby provide illumination for the flame-shaped head, and the flame-shaped head configured to reflect and/or transmit the projected light to thereby provide a flame effect;

a wobbler coupled to the flame-shaped head, at least a portion of the wobbler disposed within the housing;

a support member configured to support the wobbler, such that the wobbler rests on the support member; and a driving device coupled to the support member and configured to move the support member, to thereby move the wobbler and the flame-shaped head coupled to the wobbler.

* * * * *